US009032566B2

(12) United States Patent
Le Duff

(10) Patent No.: US 9,032,566 B2
(45) Date of Patent: May 19, 2015

(54) COMBINATION SINK AND COUNTERTOP WITH A DRAWER

(75) Inventor: Damian J. Le Duff, Chula Vista, CA (US)

(73) Assignee: RSI HOME PRODUCTS MANAGEMENT, INC., Anaheim, CA (US)

( * ) Notice: Subject to any disclaimer, the term of this patent is extended or adjusted under 35 U.S.C. 154(b) by 1015 days.

(21) Appl. No.: 12/683,976

(22) Filed: Jan. 7, 2010

(65) Prior Publication Data

US 2011/0145988 A1 Jun. 23, 2011

Related U.S. Application Data

(60) Provisional application No. 61/289,363, filed on Dec. 22, 2009.

(51) Int. Cl.
*A47B 77/06* (2006.01)

(52) U.S. Cl.
CPC ..... *A47B 77/06* (2013.01)

(58) Field of Classification Search
USPC ..... 4/630, 498; 312/228, 228.1, 330.1, 312/248.4; D6/510
See application file for complete search history.

(56) References Cited

U.S. PATENT DOCUMENTS 380,038 A 3/1888 Holt
399,461 A * 3/1889 Woodward ..... 312/228
1,853,989 A * 4/1932 Gottlieb ..... 312/205
1,891,680 A * 12/1932 Meldahl ..... 312/225
2,050,617 A 10/1935 Litner
2,130,196 A 9/1938 Sakier
2,287,657 A * 6/1942 Wisckol ..... 312/210
2,450,305 A 9/1948 Shoemaker
3,292,983 A * 12/1966 Service ..... 312/228
4,241,963 A 12/1980 Seidel
4,729,616 A 3/1988 Vogt
4,843,680 A 7/1989 Cress et al.
6,427,259 B1 8/2002 Cawthon
6,726,296 B2 * 4/2004 McGilton ..... 312/228
7,198,339 B2 4/2007 Baron
7,594,706 B2 * 9/2009 Styka et al. ..... 312/228
2005/0099101 A1 * 5/2005 Lowe ..... 312/228
2008/0079339 A1 4/2008 Hall
2008/0263761 A1 10/2008 Kohlmann et al.
2011/0145988 A1 6/2011 Le Duff

* cited by examiner

*Primary Examiner* — Lauren Crane

(74) *Attorney, Agent, or Firm* — Knobbe Martens Olson & Bear LLP

(57) ABSTRACT

A vanity assembly is provided. The vanity assembly can comprise a base, side walls, and a combination sink and countertop. The sink can have a drainage section located near a back side of the sink. The vanity assembly can further comprise a drawer configured to move relative to the sink, the drawer extending in front of the sink and utilizing a substantial portion of the space in front of the sink's drain section for storage. The drawer can have side wall sections and a bottom section configured to facilitate storage of common household items.

19 Claims, 15 Drawing Sheets

COMBINATION SINK AND COUNTERTOP WITH A DRAWER

This application claims benefit under 35 U.S.C. §119(e) to U.S. Provisional Patent Application No. 61/289,363, filed Dec. 22, 2009, which is incorporated in its entirety by reference herein.

BACKGROUND OF THE INVENTION

1. Field of the Invention

This application relates to improved vanity assemblies, specifically vanity assemblies that include a combination sink and countertop with a drawer.

2. Description of the Related Art

Vanity assemblies are commonly used in homes, particularly in bathrooms. Vanity assemblies typically comprise a combination sink and countertop type structure, with some space below the sink and countertop for storage. Many vanity assemblies are generally box-like in structure, having a base and side walls, with the combination sink and countertop resting on and/or connected to the two side walls. The space below the sink, above the base, and defined by the side walls can be used to store bathroom supplies, cleaning supplies, or any other materials that might commonly be found in the bathroom area. Some vanity assemblies also include drawers.

SUMMARY OF THE INVENTION

An aspect of at least one of the embodiments disclosed herein includes the realization that the storage space below a sink in a vanity assembly can often be limited due to the size, shape, and/or particular features of the sink. For example, a sink may comprise a substantially recessed area, for example a deep sink bowl, which extends well below the countertop. The sink may additionally comprise a drain section at the bottom of the recessed area. A deep bowl and/or drain section can inhibit the amount of space that can be used for storage in the vanity assembly. Thus, it would be advantageous to have a vanity assembly that increases the amount of usable area underneath the sink for storage purposes.

Another aspect of at least one of the embodiments disclosed herein includes the realization that users of vanity assemblies often desire drawers, in addition to or in place of cabinet-like doors that open up to a storage space near the bathroom floor. While some vanity assemblies include drawers, these drawers are either located at inconvenient areas such as near the base of the vanity, where they are difficult to access, or they extend alongside the sink, thereby not taking full advantage of space that is left in front of the sink. It would be advantageous to have a drawer which is both convenient to use, and takes advantage of the space defined in front of the sink.

Thus, in accordance with an embodiment, a vanity assembly can comprise a combination sink and countertop, the sink having a recessed region extending below a portion of the countertop, a storage area comprising two sidewalls supporting the countertop and sink, and a base extending between the sidewalls. The vanity assembly can further comprise a drawer centered between and slidably connected to the sidewalls, the drawer being moveable generally horizontally relative the sink, the drawer comprising a front face with a top edge located near a bottom of the countertop.

In accordance with another embodiment, a vanity assembly can comprise a combination sink and countertop, the sink comprising a sloped section extending towards a drain section, the drain section extending within a storage area underneath the combination sink and countertop, and a drawer in front of the sink comprising a front face section, the drawer being connected to a structure supporting the combination sink and countertop, the drawer further comprising an angled top surface which corresponds with the sloped section of the sink.

In accordance with another embodiment, a vanity assembly can comprise a combination sink and countertop, the sink comprising a drain section below a rear area of the sink, and a drawer slidably connected to the a pair of sidewalls supporting the combination sink and countertop, the drawer configured to inhibit separation of the sidewalls, wherein the drawer extends within a small horizontal distance from the drain section, and a top edge of the drawer is within a small distance of a bottom of the countertop.

In accordance with another embodiment, a vanity assembly can comprise a combination sink and countertop, the sink comprising a drain section, and a drawer centered in front of the sink near a top of the vanity assembly and connected to a structure supporting the sink, the drawer being moveable horizontally relative the sink, wherein the drawer utilizes at least 50% of the storage volume space directly in front of the drain section.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENT

Figure 1:
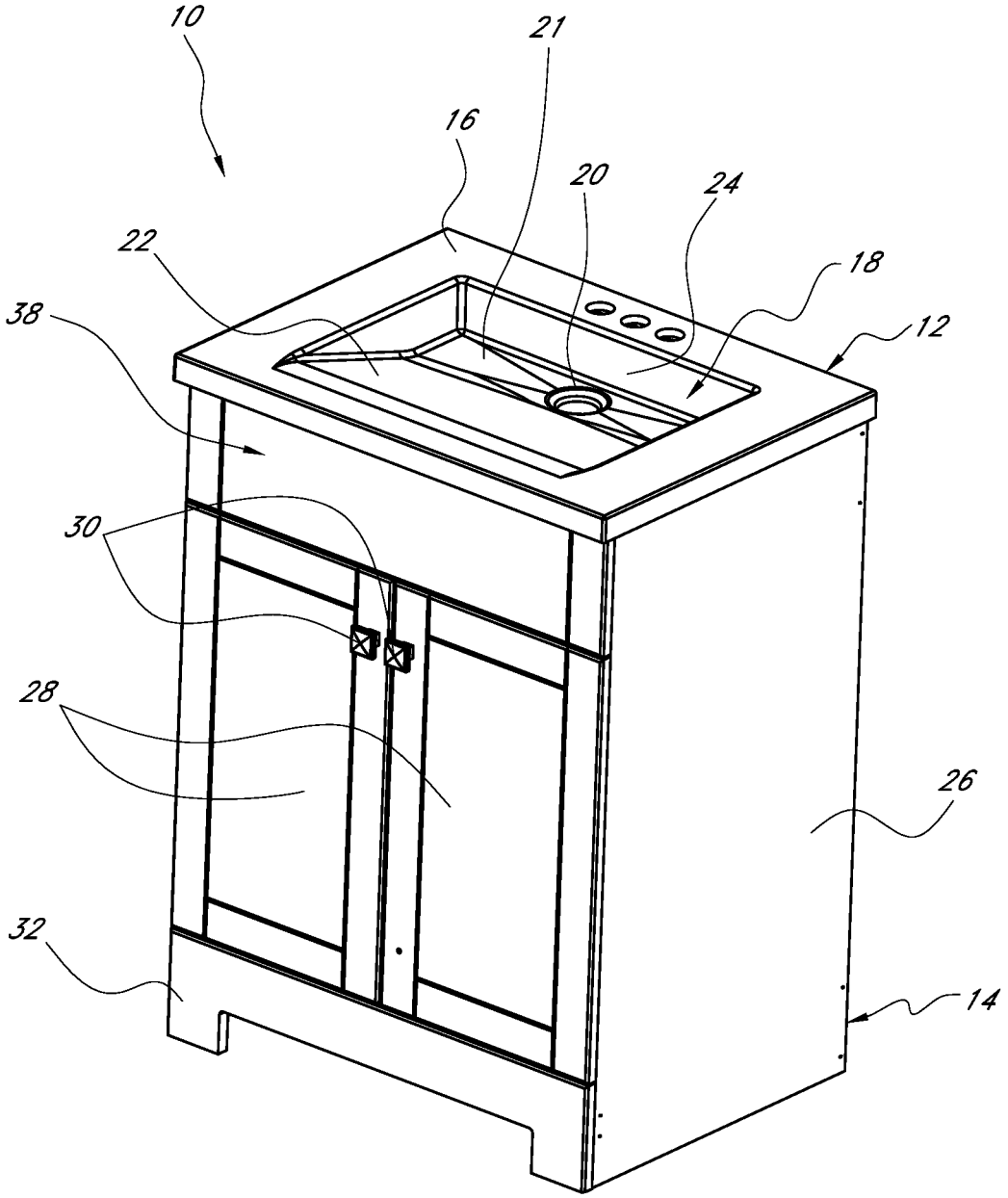
FIG. 1 is a front side perspective view of a vanity assembly according to one embodiment.
Figure 2:
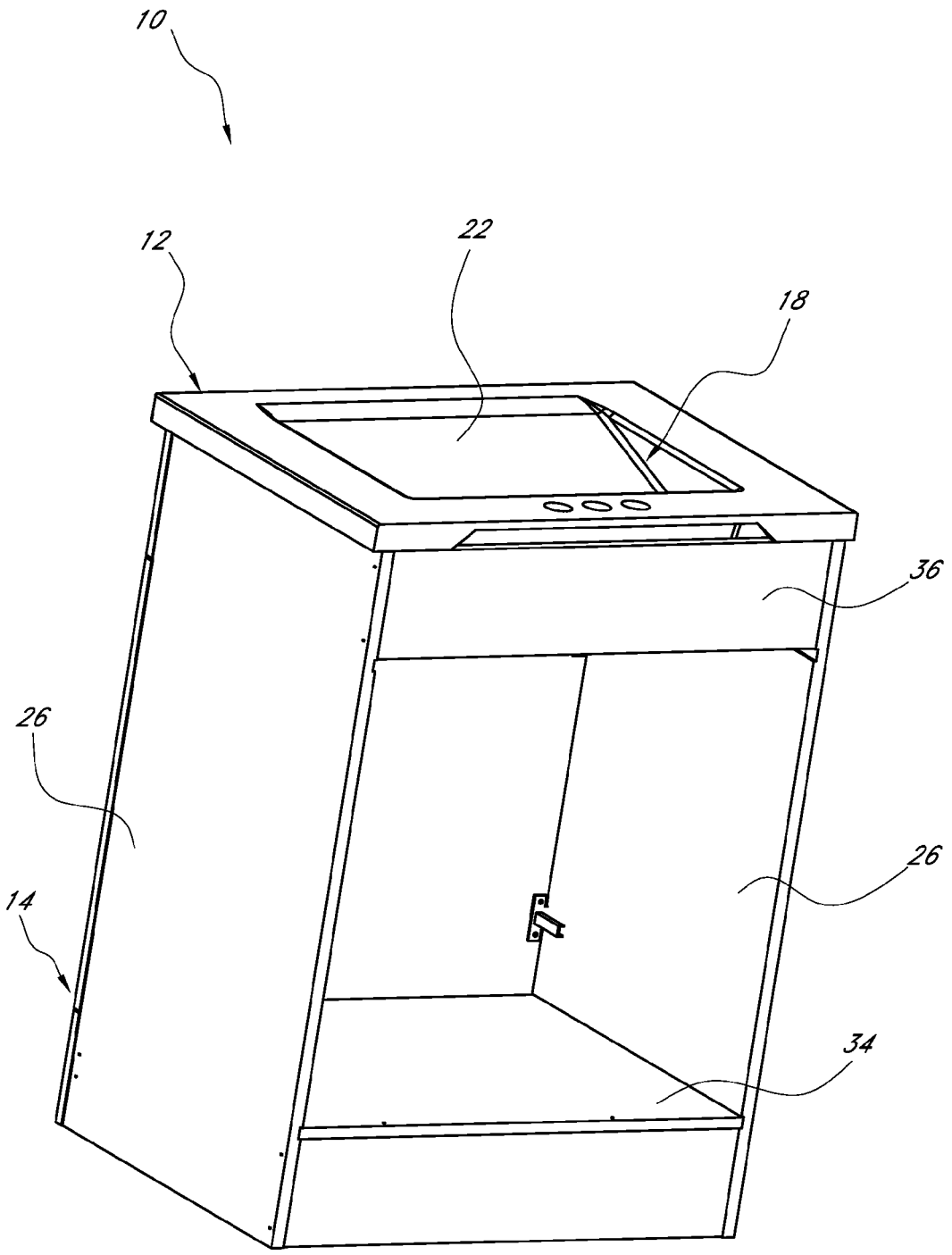
FIG. 2 is a back side perspective view of the assembly of FIG. 1.
Figure 3:
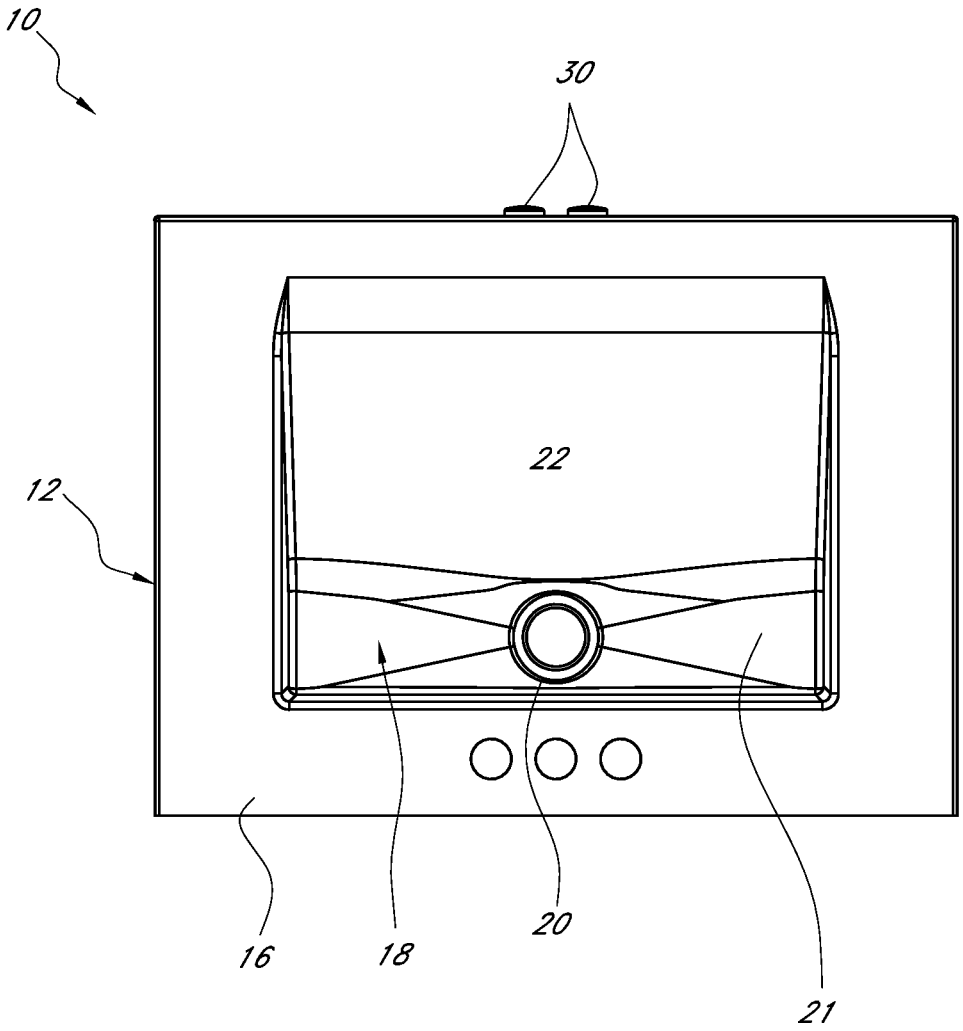
FIG. 3 is a top plan view of the assembly of FIG. 1.

An improved vanity assembly 10 is disclosed herein. The embodiments disclosed herein are described in the context of a vanity assembly for use in a bathroom because the embodiments disclosed herein have particular utility in this context. However, the embodiments and inventions herein can also be applied to types of vanity assemblies configured for other types of environments, including but not limited to garages, warehouses, kitchens, or any common storage areas.

With reference to FIGS. 1-4, a vanity assembly 10 can comprise a vanity structure 12. The vanity structure 12 can rest upon or be attached to a storage structure 14. The vanity structure 12 can comprise a combination sink and countertop. For example, the vanity structure 12 can comprise a countertop 16, and a recessed sink 18. The countertop 16 and sink 18 can be formed separately and then attached together, such as for example by mechanical fasteners (e.g. clips), adhesive, or other fastening means. In some embodiments, the countertop 16 can be formed integrally with the sink 18. In some embodiments, the sink 18 can rest within an opening formed in the countertop 16.

The countertop 16 can comprise a generally flat area surrounding the sink 18. The countertop 16 can be formed or casted from ceramic, plastic, metal, composite, or other suitable material.

The sink 18 can comprise a generally rectangular sink, although other shapes, sizes, and configurations of sinks are also possible. The sink can be formed of heated ceramic material, plastic, metal, composite, or other suitable material. The sink 18 can comprise a generally recessed region. For example, the sink 18 can comprise a generally recessed region defined by a drain area 20, drain collection section 21, sloped section 22, and back wall 24. The drain area 20 can comprise a generally rounded opening within the body of the sink 18. The drain area 20 can be formed anywhere along the sink. In a preferred arrangement, the drain area 20 can be located between the sloped section 22 of the sink 18 and back wall 24, along the drain collection section 21. The drain area 20 can be located generally towards the back of the sink 18, for example, adjacent the back wall 24.

The sloped section 22 can extend from an edge of the sink to the drain area 20. The sloped section 22 can have a substantially gradual slope. For example, the sloped section 22 can have a slope of approximately 10 degrees relative to the countertop 16. In some embodiments, the sloped section 22 can have a slope not greater than 10 degrees relative to the countertop 16. In some embodiments, the sloped section 22 can have a slope not greater than 15 degrees relative to the countertop 16. In some embodiments, the sloped section 22 can have a slope not greater than 20 degrees relative to the countertop 16. In some embodiments, the sloped section 22 can have a slope not greater than 25 degrees relative to the countertop 16. Other ranges of slopes are also possible. Additionally, the sloped section 22 can have a generally rectangular shape, although other shapes are also possible as well. For example, the sloped front surface can have a trapezoidal shape, or a generally triangular shape.

Figure 4:
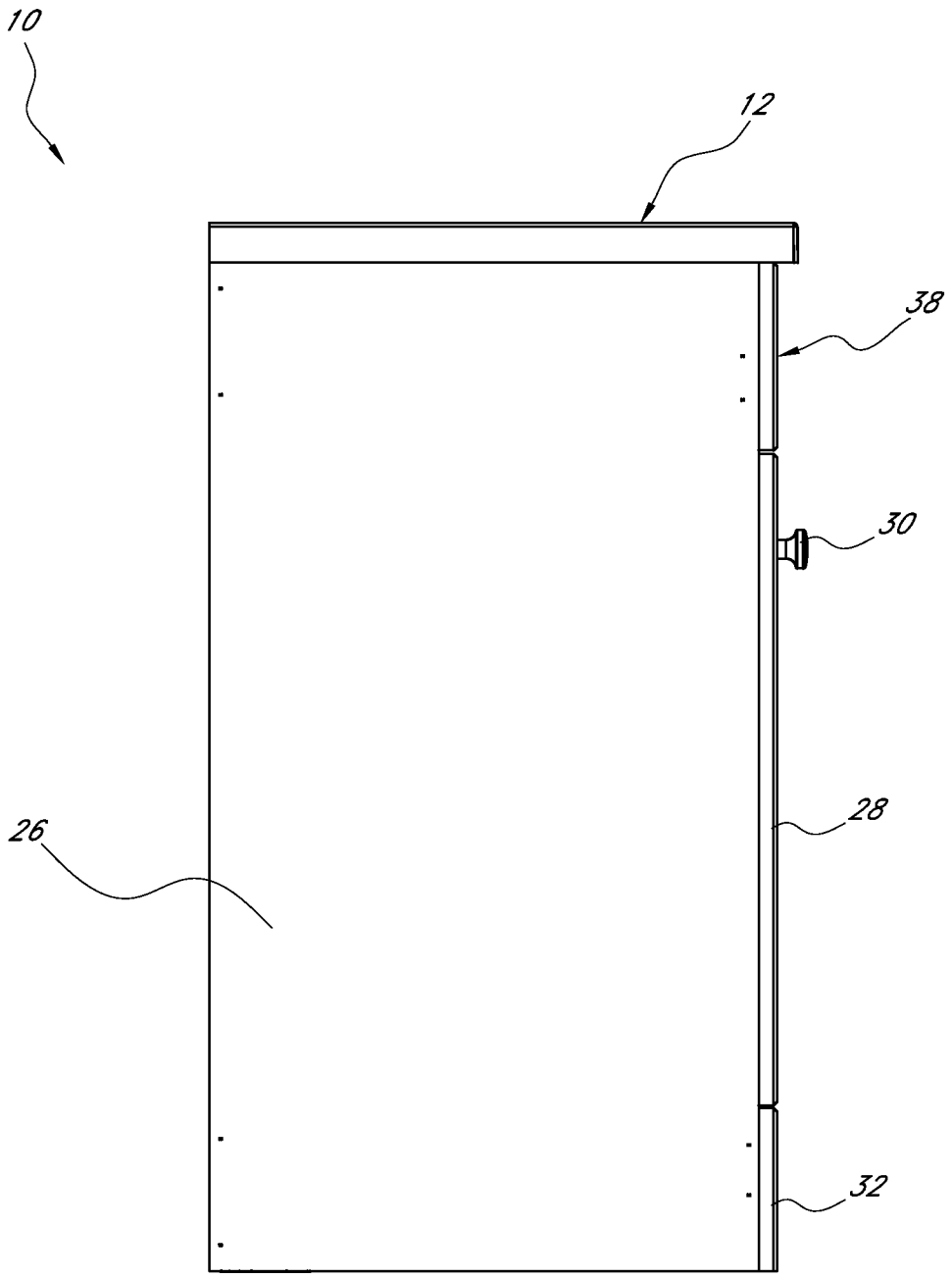
FIG. 4 is a right side elevational view of the assembly of FIG. 1.
Figure 4A:
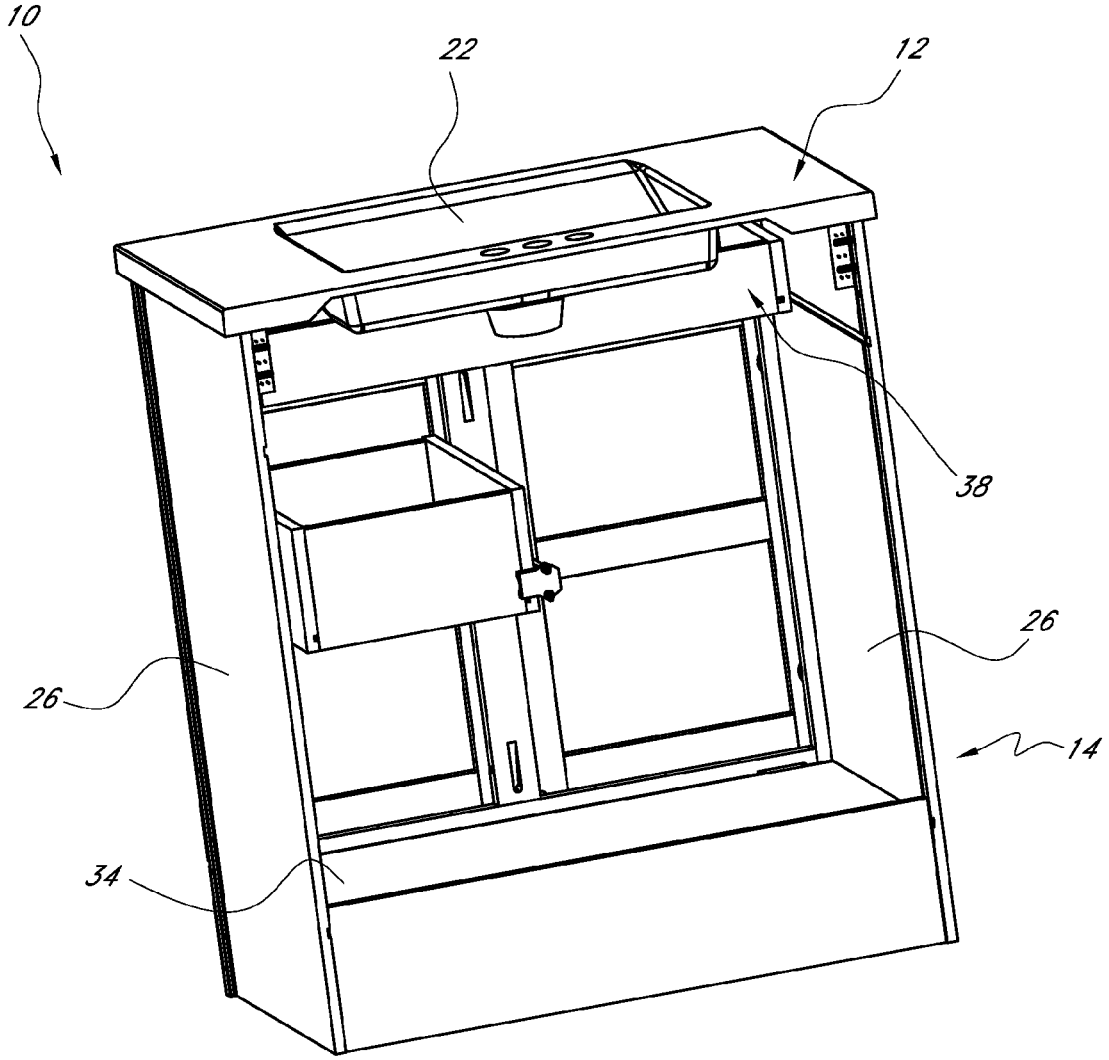
FIG. 4A is a back side perspective view of a vanity assembly incorporating a framed cabinet.

With continued reference to FIGS. 1-4, storage structure 14 can comprise at least one side wall 26. The side walls 26 can support the vanity structure 12. For example, the storage structure 14 can comprise two side walls 26 that are located on either side of the vanity structure 12, and provide support for the vanity structure 12. In some embodiments, the vanity structure 12 can be attached to or integrally formed with the side walls 26. The side walls 26 can be formed from wood, plastic, composite, or other suitable material. The side walls 26 can have a generally rectangular shape, although other shapes and sizes are also possible. In some embodiments, instead of having separate side walls 26, the storage structure 14 can comprise a common framed cabinet, such as for example as illustrated in FIG. 4A. For example, there can be no front doors 28 which are separately attached by hinges to the side walls 26. Rather, the storage structure 14 can comprise a single framed structure.

The storage structure 14 can further comprise at least one door 28. The doors 28 can be located along a front side of the vanity assembly 10. The doors 28 can be located below the countertop 16 and sink 18, and can swing open to provide access to a storage area underneath the countertop 16 and sink 18. The doors 28 can be hinged to the sidewalls 26. The doors can provide at least one handle 30, such as for example a small door knob. The doors 28 can be arranged symmetrically underneath the sink 18, giving the vanity assembly 10 a desirable aesthetic appearance.

The storage structure 14 can further comprise a front base 32, an interior base 34, and a back panel 36. The front base 32 can provide support for the vanity assembly 10. The front base 32 can comprise a long, thin piece of wood, composite, or other material extending in a vertical plane along the bottom of the vanity assembly 10. The front base 32 can be in contact with the bathroom (or other room) floor. The front base 32 can extend between the sidewalls.

The interior base 34 can comprise a lower surface for placing household items such as buckets, cleaning supplies, bathroom items, or other materials. The interior base 34 can be located near the bottom of the vanity assembly 10, and near the floor of a bathroom or other room. The interior base 34 can extend between the sidewalls 26 in a horizontal plane.

The back panel 36 can be located near the top of the vanity assembly 10. The back paneling 36 can comprise a long, thin piece of wood, composite, or other material extending in a vertical plane along the top, back side of the vanity assembly 10.

With reference to FIGS. 1 and 4-7, the storage structure 14 can comprise a drawer 38. The drawer 38 can be used to store additional materials, such as toothbrushes, toothpaste, shaving cream, or other articles. The drawer 38 can be located near the top of the vanity assembly 10. In some embodiments, the drawer 38 can be located between the doors 28 and the countertop 16. The drawer 38 can extend the entire, or substantially the entire, width of the vanity assembly 10. In some embodiments, the drawer 38 can be centered between the sidewalls 26. The drawer 38 can be moved generally horizontally (e.g. parallel to the countertop 16) in and out of the storage assembly 14.

Figure 5:
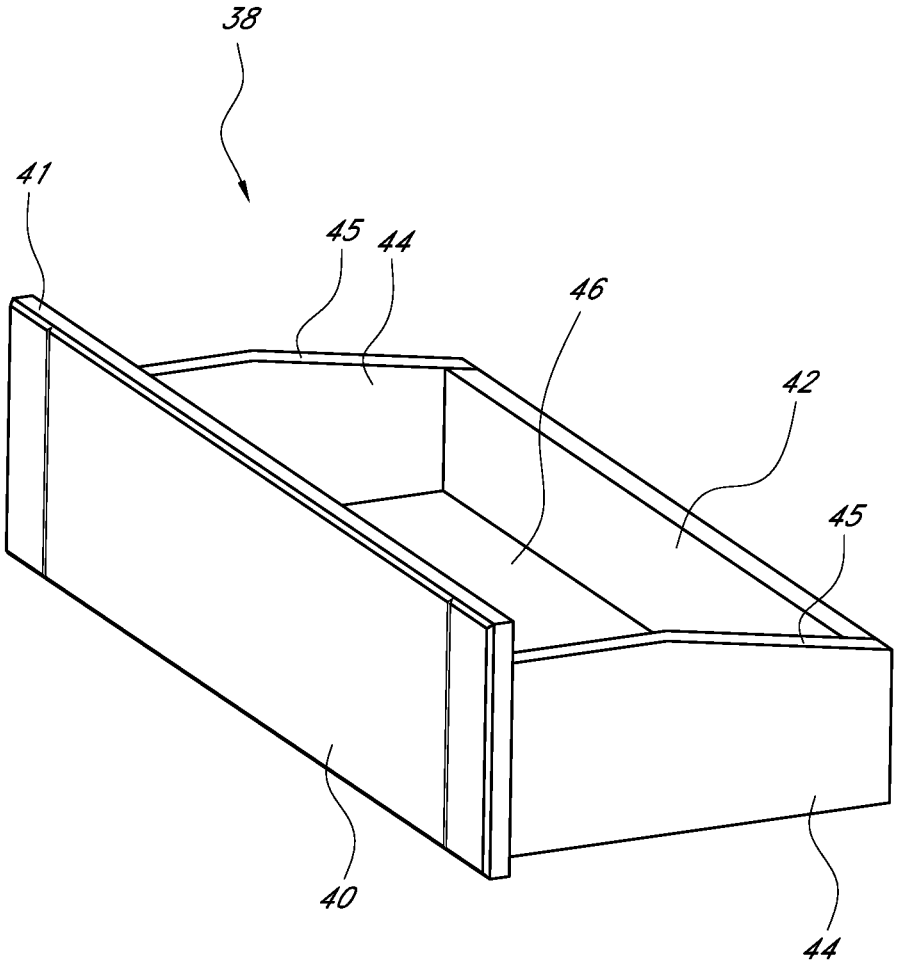
FIG. 5 is a front side perspective view of a drawer forming part of the assembly of FIG. 1.
Figure 6:
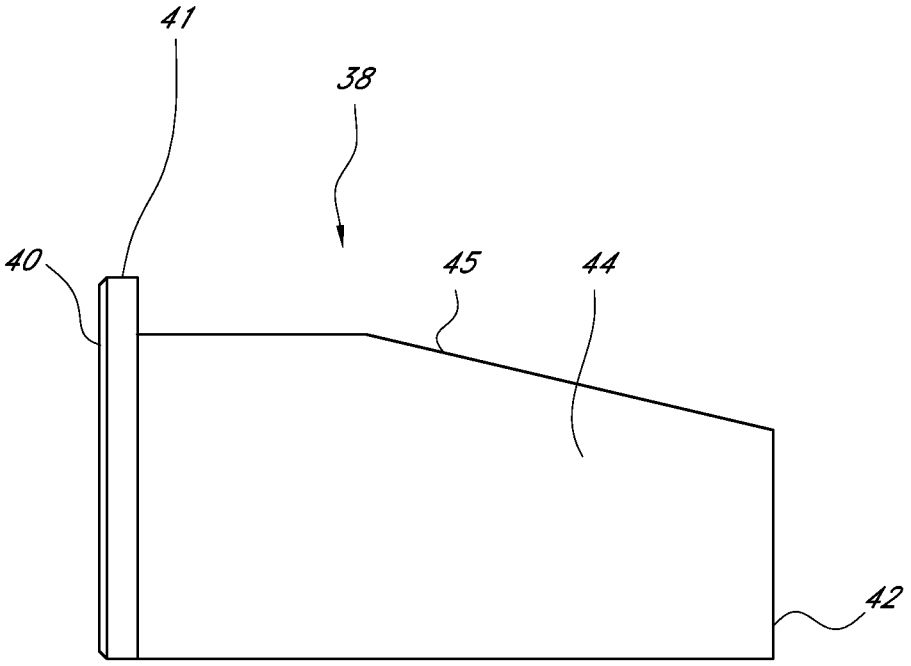
FIG. 6 is a left side elevational view of a the drawer of FIG. 5.
Figure 7:
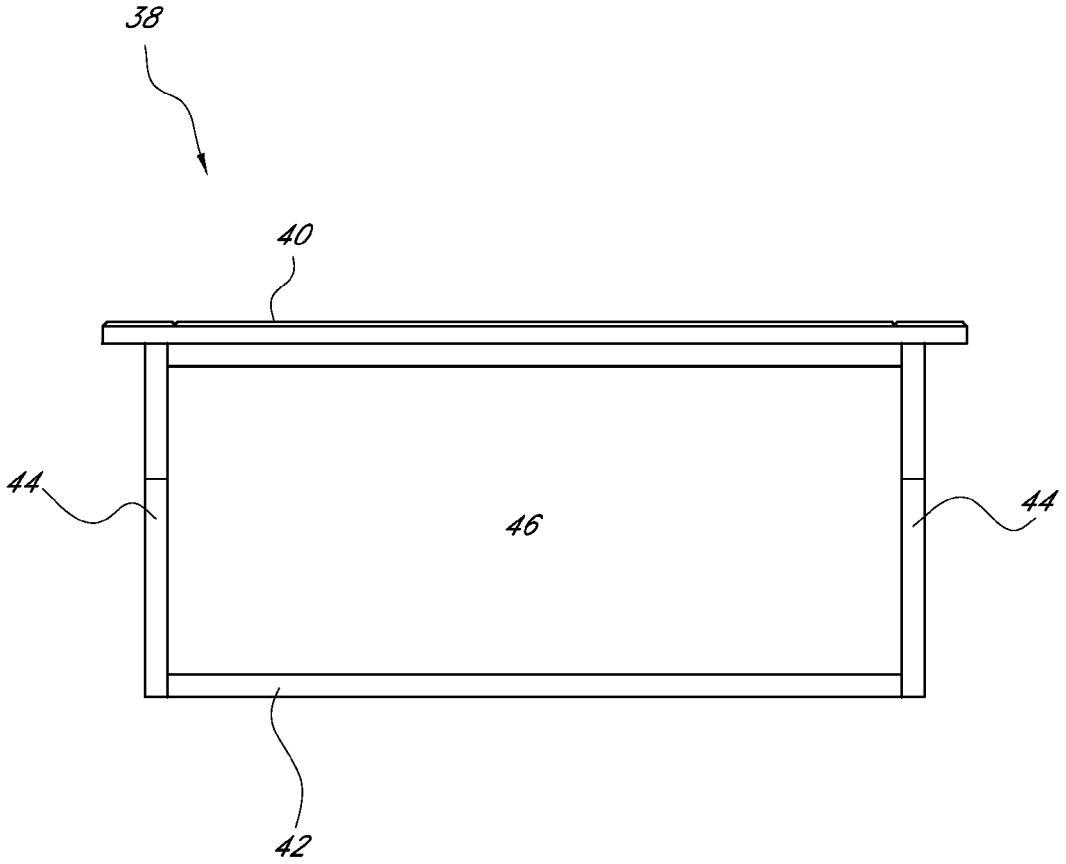
FIG. 7 is a top plan view of the drawer of FIG. 5.

With reference to FIGS. 5-7, the drawer 38 can comprise a front side section 40 having a top edge 41. The front side section 40 can comprise a generally flat piece of wood, composite, or other material extending in a vertical plane. The front side section 40 can resemble and/or function similar to a header for the vanity assembly 10. For example, the front side section 40 and drawer 38 can provide support for the vanity assembly 10. The front side section 40 can have a generally rectangular configuration, although other shapes and sizes besides that shown in FIG. 5 are also possible. In some embodiments, the drawer 38 can have a handle, such as a knob. In those embodiments without a handle, the size and shape of the front side section 40 can make it difficult for an observer to know whether the front side section 40 forms part of a drawer. For example, the front side section 40 can resemble merely a part of a support structure underneath the countertop. This can be advantageous if it is desired for the existence of the drawer 38 to remain hidden.

With continued reference to FIGS. 5-7, the drawer 38 can comprise at least one drawer back side section 42 and drawer side section 44 with a drawer side top edge 45. The drawer side sections 44 can be recessed inwardly from the front side section 40, such that a width of the front side section 40 is greater than a width between the drawer side sections 44.

The drawer 38 can further comprise a drawer bottom section 46. The drawer front side section 40, side sections 44, back side section 42, and bottom section 46 can surround a storage area. The storage area formed by the drawer sections can be used to hold and store bathroom items (e.g. shaving cream toothbrushes), cleaning supplies, or any other items that might fit within a space defined by the drawer sections.

Figure 8:
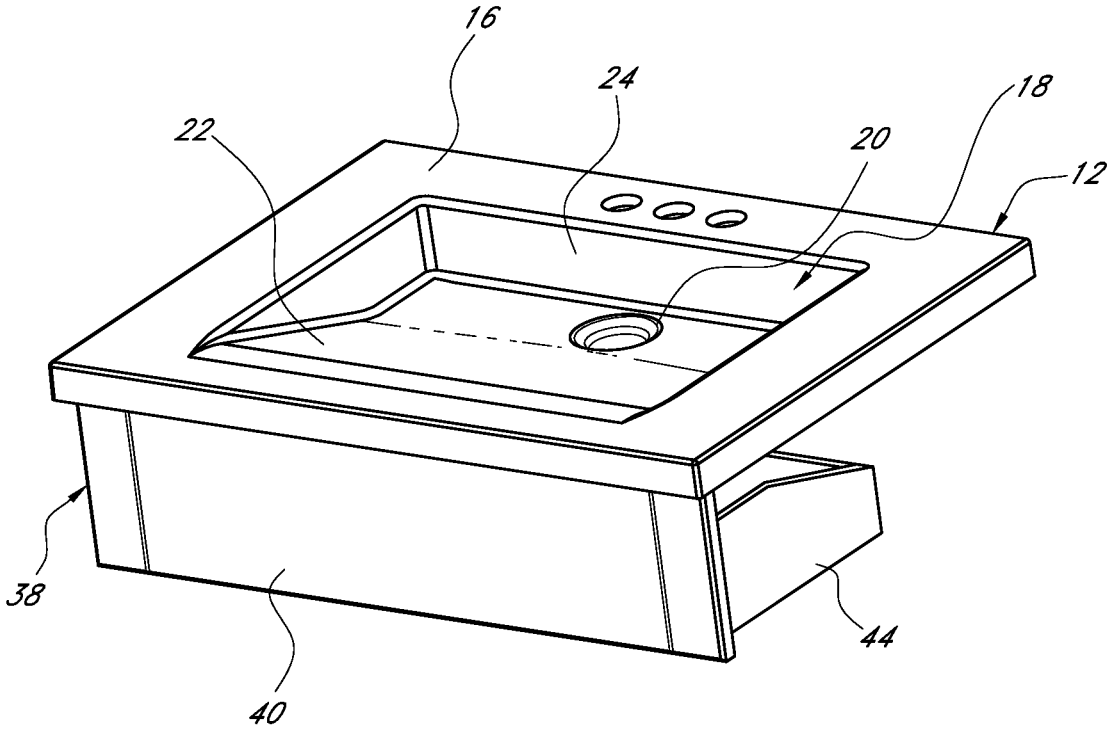
FIG. 8 is a front side partial perspective view of the assembly of FIG. 1.
Figure 9A:
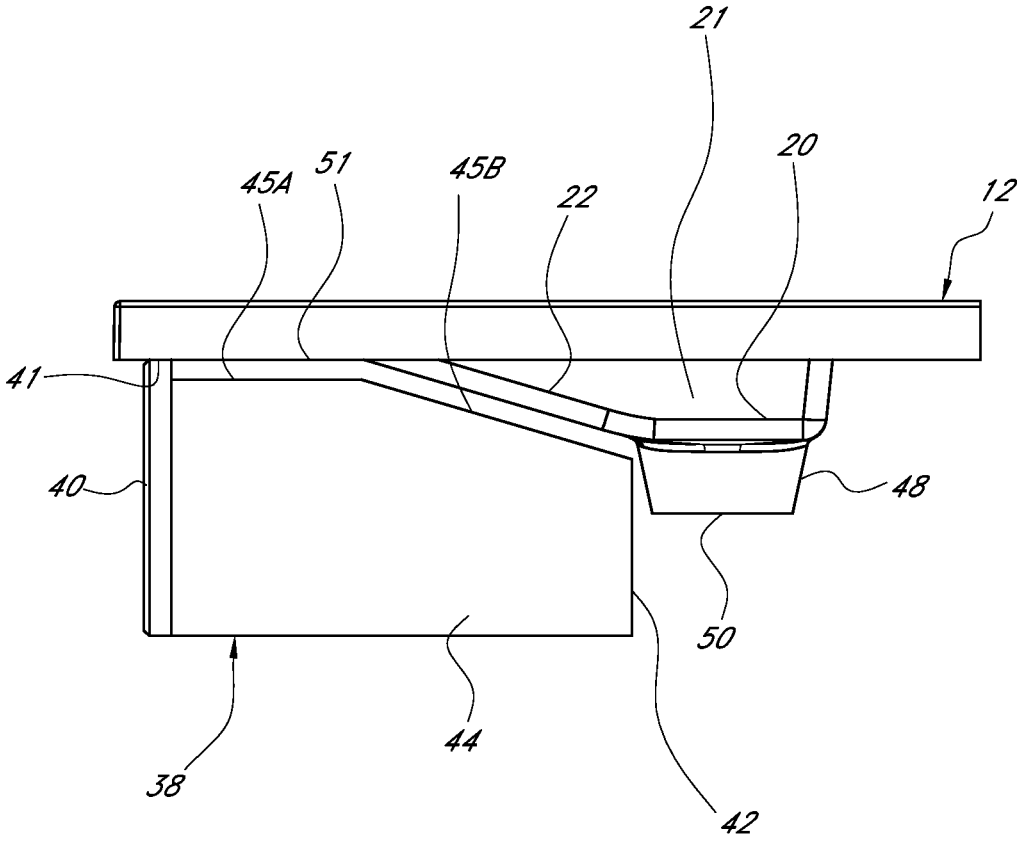
FIG. 9A is a left side partial elevational view of the assembly of FIG. 1.
Figure 9B:
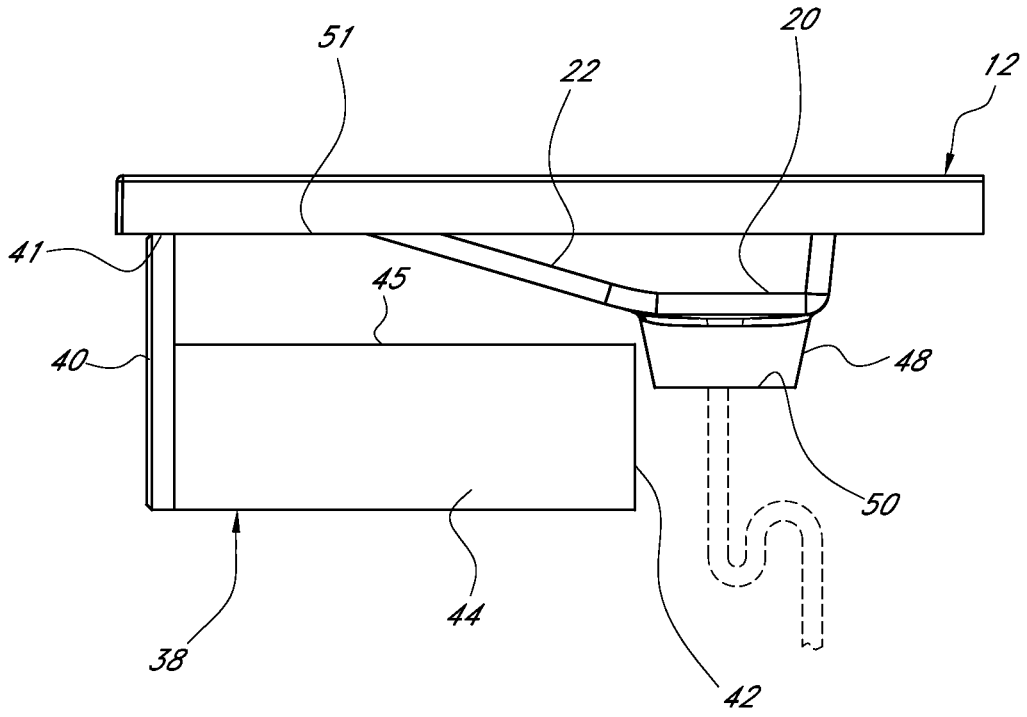
FIG. 9B is a left side partial perspective view of the assembly of FIG. 1, showing an alternative embodiment of the drawer of FIG. 5.
Figure 10:
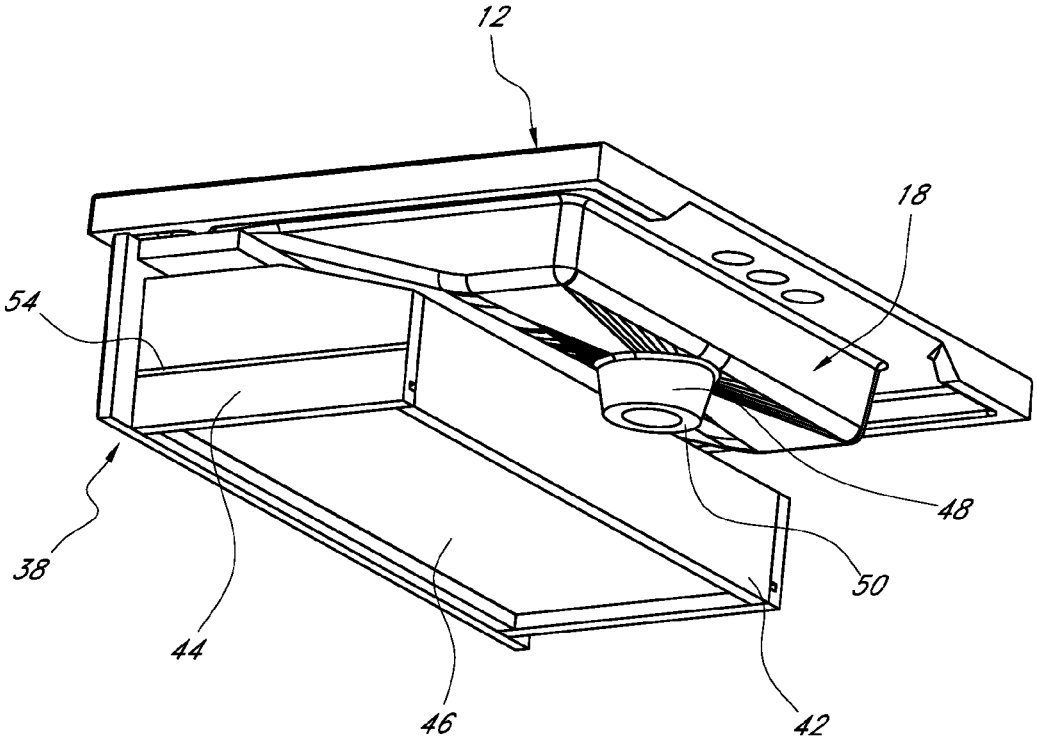
FIG. 10 is a bottom partial perspective view of the assembly of FIG. 1.

With reference to FIGS. 8-10, the drawer 38 can be positioned underneath the countertop 16 and sink 18, such that the front side section 40 is recessed slightly inwardly from the countertop in a horizontal direction (i.e. to the right in FIG. 9A). In other embodiments, the front side section 40 can be flush with the countertop 12. In some embodiments, the front side section 40 can be flush with the doors 28, such as illustrated in FIG. 4.

The top surface 41 of front side section 40 can be positioned in close proximity to the countertop 12. For example, the top surface 41 can be positioned such that clearance is minimized between the top surface 41 and the countertop 12. For example, the top surface 41 can be within 1 inch of a bottom 51 of the countertop 12. In some embodiments, the top surface 41 can be within ½ inch of the bottom 51 of the countertop 12. In some embodiments, the top surface 41 can be within ¼ inch of the bottom 51 of the countertop 12. In some embodiments, the top surface 41 can be within ⅛ inch of the bottom 51 of the countertop 12. Other ranges are also possible.

The back side section 42 can be positioned such that is it is in close proximity to, or in contact with, a drain section 48. The drain section 48 can extend down from the drain area 20 in the sink 18 and into the storage area defined at least in part by the sidewalls 26. For example, and as illustrated in FIG. 9B, the drain section 48 can extend down as piping in a generally S-shaped manner. The drain section 48 can comprise a generally cylindrical or conical wall, with a bottom surface 50. The back side section 42, or a portion of the back side section 42, can be positioned in close proximity to the drain section 48 along a direction parallel to that of the countertop 12 (e.g. horizontally). The back side section 42 can be positioned such that the drawer 38 is never in contact with the drain section 48. The back side section 42 can be positioned such that the drawer 38 is always in front of the drain section 48 (e.g. to the left of drain section 48 in FIG. 9A). In some embodiments, the back side section 42 is positioned within 0.5 inches of the drain section 48 along a horizontal direction extending from the front side section 40 to the back section 42, as viewed in FIG. 9A when the drawer 38 is in a closed position. In some embodiments, the back side section 42 is positioned within 1 inch of the drain section 48 along a horizontal direction extending from the front side section 40 to the back section 42, as viewed in FIG. 9A when the drawer 38 is in a closed position. In some embodiments, the back side section 42 is positioned within 1.5 inches, within 2.0 inches, within 2.5 inches or within 3.0 inches of the drain section 48 along a horizontal direction extending from the front side section 40 to the back section 42, as viewed in FIG. 9A. Other ranges are also possible.

In some embodiments, the surface 50 of the drain section 48 is positioned lower along a vertical direction than that of the top surface 45 of side section 44, such as illustrated in FIG. 9A. In some embodiments, a majority of the drain section 48 is positioned lower along a vertical direction than that of the top surface 45 of the side section 44.

With continued reference to FIGS. 9A and 9B, the front side section 40 can have a height greater than that of the side section or sections 44. For example, in some embodiments the drawer 38 does not define a channel extending the height of the drawer. This difference in height can accommodate for the sloped section 22 of sink 18. Without a difference in height, the sloped section 22 could inhibit the drawer 38 from sliding horizontally relative to the countertop 12, and the back side section 42 of drawer 38 would not be able to extend within close proximity to the drain section 48. Thus, having a front side section 40 which is greater in height than the side section 44 advantageously allows for greater use of the storage area underneath the countertop 12 and in front of the drain section 48. Additionally, having the drain area 22 and drain section 48 located in the rear of the sink 18 permits greater use of storage space within the storage structure 14.

In some embodiments, the height of the front face 40 and side sections 44 can be based, at least in part, by the types of items to be stored. For example, the height of the front face 40 and side sections 44 can be made high enough to permit storage of bottles of shaving cream or other material within the drawer 38. For example, the height of the side sections 44, and also back side section 42, can be high enough to inhibit the bottles from falling out of the drawer 48. In some embodiments, the ratio of the height of the side sections 44 to the front side section 40 can be approximately 2:3. In some embodiments, the ratio can be less than 2:3. In some embodiments, the ratio can be less than 1:3. In some embodiments, the ratio can be less than 1:6. Other ranges are also possible.

In some embodiments, the height of the sink 18 can be defined as the distance between the bottom 51 of countertop 16 and the bottom surface 50 of the drain section. The ratio of the height of the front side section 40 to the height of the sink can be approximately 1:1. In some embodiments, the ratio can be greater than 1:1. Other ranges are also possible.

With reference to FIG. 9A, in some embodiments the drawer side sections 44 can extend to within close proximity of the countertop 12 and/or sloped section 22. For example, the side sections 44 can have top surfaces 45 that are defined by individual surfaces 45A and 45B. The top surface 45B can be formed by cutting out a part of the side section 44. The top surface 45B can be angled, such that it runs generally parallel to the sloped section 22 of sink 18. The top surface 45B can be angled such that it is in close proximity to the sloped section 22. In some embodiments, the top surface 45B can be positioned within 0.5 inches of the sloping section 22. In some embodiments, the top surface 45B can be positioned within 1 inch of the sloping section 22. In some embodiments, the top surface 45B can be positioned within 1.5 inches of the sloping section 22. Other ranges are also possible.

In some embodiments, the top surface 45A can extend from the front side section 40 to the beginning of sloped section 22 of the sink 18. In some embodiments, the top surface 45A can be positioned within 0.5 inches of the bottom 51 of countertop 12. In some embodiments, the top surface 45A can be positioned within 1 inch of the bottom 51 of countertop 12. In some embodiments, the top surface 45A can be positioned within 1.5 inches of the bottom 51 of countertop 12. Other ranges are also possible.

With reference to FIG. 9B, in some embodiments, the drawer 38 can have a generally rectangular shape, with side sections 44 that have generally horizontal top surfaces 45.

In some embodiments, the corner defined by the intersection of surfaces 45 or 45B, and back section 42, can be positioned within 0.5 inches of the sloped section 22. In some embodiments, the corner the corner defined by the intersection of surfaces 45 or 45B, and back section 42, can be positioned within 1 inch of the sloped section 22. In some embodiments, the corner defined by the intersection of surfaces 45 or 45B, and back section 42, can be positioned within 1.5 inches of the sloped section 22. Other ranges are also possible.

With reference to FIGS. 8-12, the drawer 38 can be positioned within the storage assembly 14 such that the drawer 38 utilizes at least one half of any available storage space defined by the area directly in front of the drain section 48, in between the sidewalls 26, below the countertop 16 and sink 18, and above the bottom section 46 of the drawer 38. In some embodiments, the drawer 38 can utilize at least ⅔ of the any available storage space directly in front of the drain section 48. In some embodiments, the drawer 38 can utilize at least ⅚ of any available storage space directly in front of the drain section 48. Other ranges are also possible.

Figure 11:
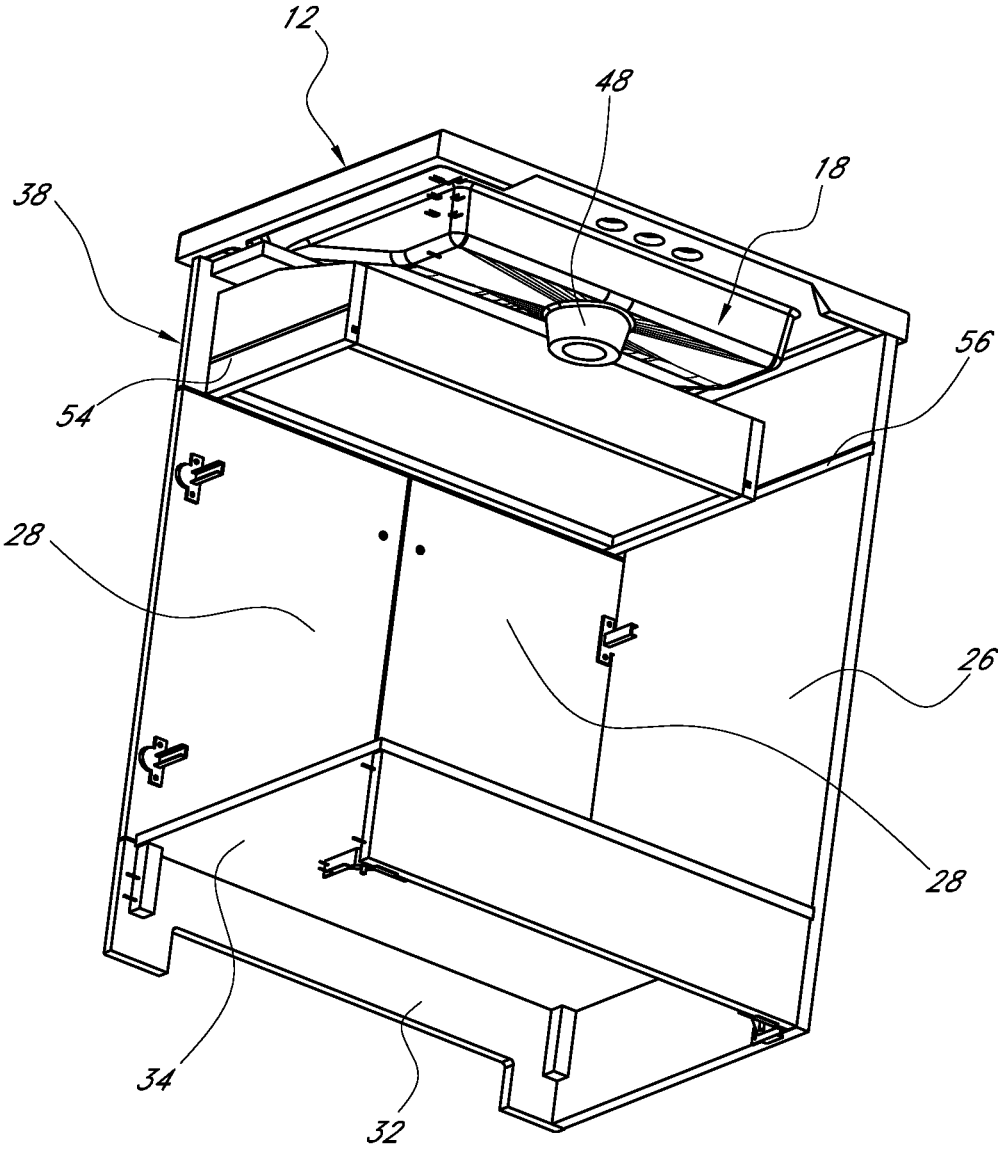
FIG. 11 is a bottom partial perspective view of the assembly of FIG. 1.
Figure 12:
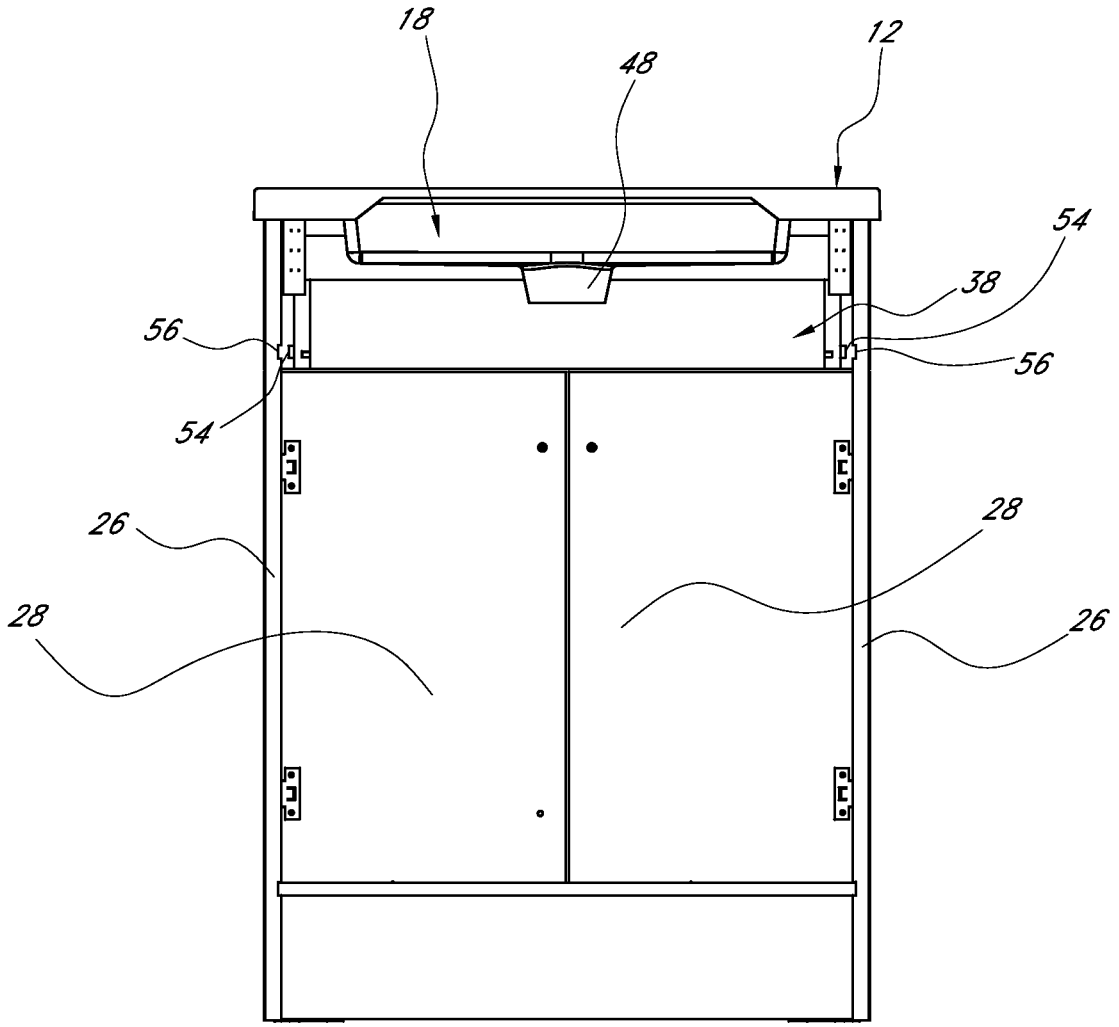
FIG. 12 is a back side partial elevational view of the assembly of FIG. 1.
Figure 13:
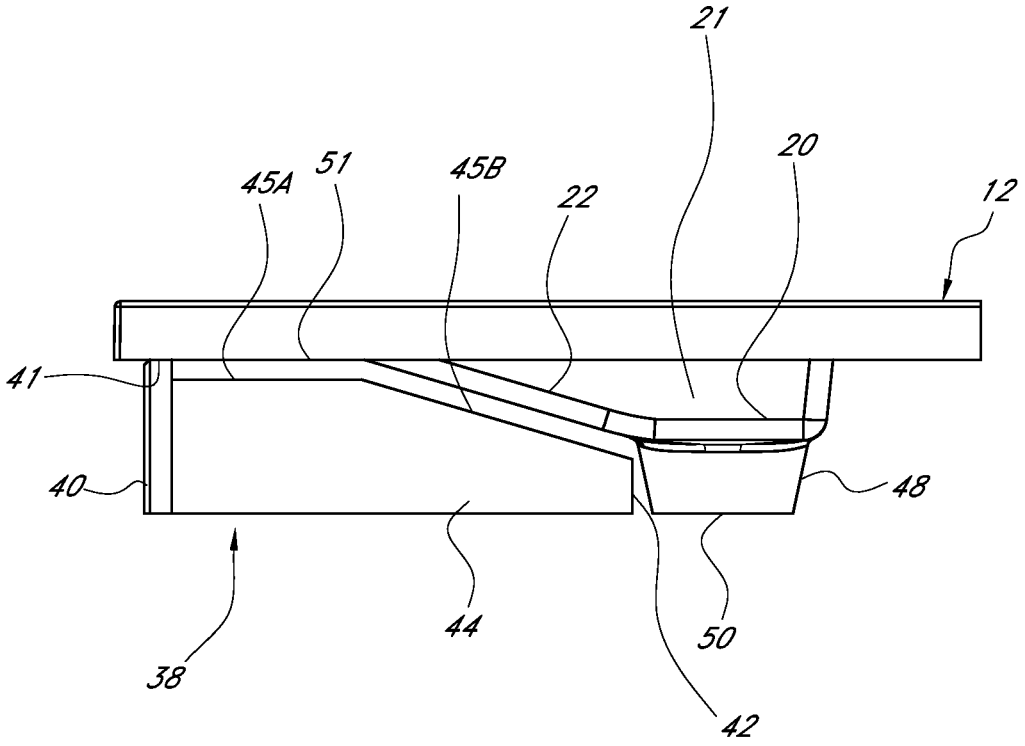
FIG. 13 is a left side partial perspective view of the assembly of FIG. 1, showing an alternative embodiment of the drawer of FIG. 5.

With reference to FIGS. 11 and 12, the drawer 38 can be connected to at least one of the side sections 26. For example, the drawer 38 can be slidably connected to the side sections 44. The drawer 38 can move relative to the side sections 46, for example through use of a slide channel or channels 56. The slide channel 56 can be built into the side section 46, and can comprise a notched and/or recessed area along an inner portion of the side section 26. In some embodiments, the channel 56 be a separately formed structure which is attached to the inside of sidewall 26. The channel 56 can accommodate a corresponding roller, protruding channel, or other similar structure on or attached to the drawer 38, such as for example protruding channel 54 illustrated in FIGS. 11 and 12. The drawer 38 can be moved (e.g. pulled in and out) generally horizontally relative to the countertop 16. In some embodiments, the channel 56 can include a stop or other structure to inhibit the drawer 38 from being pulled completely out of the vanity storage structure 14.

With continued reference to FIGS. 11 and 12, the drawer 38, when connected to the sidewalls 26, can inhibit the sidewalls from separating. The drawer 38 can hold the sidewalls 26 together. In some embodiments, the drawer 38 is arranged such that at least one of the side sections 44 is within 0.5" of a sidewall 26 along a direction extending between the sidewalls 26. In some embodiments, the drawer 38 is arranged such that at least one of the side sections 44 is within 1" of a sidewall 26 along a direction extending between the sidewalls 26. In some embodiments, the drawer 38 is arranged such that at least one of the side sections 44 is within 1.5" of a sidewall 26 along a direction extending between the sidewalls 26. Other ranges are also possible.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A vanity assembly comprising:

a combination sink and countertop, the sink having a drain section and a recessed region extending below a portion of the countertop, said recessed region including a sloped section toward the front of the sink;

a storage structure comprising two external sidewalls supporting the countertop and sink, and a base extending between the sidewalls, said sidewalls comprising external sidewalls of the vanity assembly; and a drawer centered between and slidably connected to the sidewalls via slide mechanisms, the slide mechanisms supported by the external sidewalls, the drawer cooperating with the sidewalls to hold the sidewalls together, the drawer being moveable generally horizontally relative the sink, the drawer comprising a front side section defining a front face with a top edge located near a bottom of the countertop, at least a portion of the drawer positioned below the recessed region of the sink when the drawer is in a closed position, the drawer extending horizontally to within 3 inches of the drain section when the drawer is in the closed position.

2. The vanity assembly of claim 1, wherein the front side section has a height, the sink has a height, and wherein the ratio of the height of the front side section of the drawer to the height of the sink is approximately 1:1.

3. The vanity assembly of claim 1, wherein the front side section has a height, and a side section of the drawer has a height, and wherein the ratio of the height of the side section of the drawer to the height of the front side section is less than 2:3.

4. The vanity assembly of claim 1, wherein the front side section acts as a header for said assembly when said drawer is in the closed position.

5. The vanity assembly of claim 1, wherein the front side section extending substantially the entire width of the vanity assembly between the sidewalls.

6. The vanity assembly of claim 1, wherein the countertop and sink are integrally formed.

7. The vanity assembly of claim 1, wherein a bottom section of the drawer has a rectangular configuration.

8. The vanity assembly of claim 1, wherein the drawer has the front side section, two side sections, a bottom section, and a back side section, and wherein the front side section has a greater height than the side and back side sections.

9. The vanity assembly of claim 1, wherein the drawer has the front side section, two side sections, a bottom section, and a back side section, and wherein the side sections have angled portions corresponding to a sloped section of the sink.

10. The vanity assembly of claim 9, wherein the angled portions and sloped section of the sink are substantially parallel.

11. The vanity assembly of claim 1, wherein the drawer comprises side sections and wherein the front side section has a greater height than the side sections.

12. The vanity assembly of claim 1, wherein the drawer does not extend rearwardly to or past the drain section of the sink.

13. A vanity assembly comprising:

a combination sink and countertop, the sink comprising a sloped section extending towards a drain section, the drain section extending within a storage structure underneath the combination sink and countertop;

the storage structure comprising two external sidewalls supporting the countertop and sink, said sidewalls comprising external sidewalls of the vanity assembly; and a drawer in front of the sink comprising a front side section defining a front face, the drawer being connected to a structure supporting the combination sink and countertop via slide mechanisms, the slide mechanisms supported by the external sidewalls, the drawer cooperating with the sidewalls to hold the sidewalls together, at least a portion of the drawer positioned below the recessed region of the sink when the drawer is in a closed position, the drawer extending horizontally to within 3 inches of the drain section when the drawer is in the closed position, the drawer further comprising an angled top surface which corresponds with the sloped section of the sink.

14. A vanity assembly comprising:

a combination sink and countertop, the sink comprising a drain section in a rear area of the sink and a recessed region extending below a portion of the countertop, said recessed region including a sloped section toward the front of the sink;

a storage structure comprising two external sidewalls supporting the countertop and sink, and a base extending between the sidewalls, said sidewalls comprising external sidewalls of the vanity assembly; and a drawer slidably connected to the pair of sidewalls supporting the combination sink and countertop via slide mechanisms, the slide mechanisms supported by the external sidewalls, the drawer cooperating with the sidewalls to hold the sidewalls together, at least a portion of the drawer positioned below the recessed region of the sink when the drawer is in a closed position;

wherein the drawer extends within a small horizontal distance from the drain section when the drawer is in the closed position, and a top edge of the drawer is within a small vertical distance of a bottom of the countertop.

15. The vanity assembly of claim 14, wherein the small horizontal distance is no greater than 3 inches.

16. The vanity assembly of claim 14, wherein the small vertical distance is no greater than 1.5 inches.

17. A vanity assembly comprising:

a combination sink and countertop, the sink comprising a drain section and a recessed region including a sloped section toward a front of the sink;

a storage structure comprising two external sidewalls supporting the countertop and sink, said sidewalls comprising external sidewalls of the vanity assembly; and a drawer centered in front of the sink near a top of the vanity assembly and connected to a structure supporting the sink via slide mechanisms, the slide mechanisms supported by the external sidewalls, the drawer cooperating with the sidewalls to hold the sidewalls together, at least a portion of the drawer positioned below the recessed regions of the sink when the drawer is in a closed position, the drawer being moveable horizontally relative the sink, the drawer extending horizontally to within 3 inches of the drain section when the drawer is in the closed position;

wherein the drawer utilizes at least 50% of the storage volume space directly in front of the drain section.

18. The vanity assembly of claim 1, wherein the recessed region of the sink comprises a sloped section extending between the drain section and a front of the recessed region.

19. The vanity assembly of claim 18, wherein the sloped section has a substantially constant slope relative to horizontal.

* * * * *